United States Patent [19]

Lee et al.

[11] Patent Number: 5,000,354

[45] Date of Patent: Mar. 19, 1991

[54] CONTAINER FOR FLUIDS

[76] Inventors: Young J. Lee; Kyoung S. Kim, both of Keongil Apt. #106 (Bldg. B), Seoksoo-dong, Anyang-shi, Kyeonggi-do, Rep. of Korea

[21] Appl. No.: 306,845

[22] Filed: Feb. 7, 1989

[30] Foreign Application Priority Data

Apr. 8, 1988 [KR] Rep. of Korea ..... 88-3994

[51] Int. Cl.[5] ..... B65D 37/00

[52] U.S. Cl. ..... 222/213; 222/181; 222/518

[58] Field of Search ..... 222/48, 150, 153, 210, 222/212, 213, 511, 518, 559, 181

[56] References Cited

U.S. PATENT DOCUMENTS 867,292 10/1907 Neef ..... 222/181
3,244,332 11/1964 Rogers ..... 222/213
4,467,931 8/1984 Gach ..... 222/153

FOREIGN PATENT DOCUMENTS 595557 7/1959 Italy ..... 222/213

*Primary Examiner*—H. Grant Skaggs
*Assistant Examiner*—Steve Reiss
*Attorney, Agent, or Firm*—Spencer & Frank

[57] ABSTRACT

A container for fluids made of a container body having a flat bottom, a wall extending from the bottom, and a fluid-filling hole opposing the bottom. The wall of this container is made of an elastic material and has at least one internal stop. A actuation rod is disposed within the container and is made of a main rod, a head portion at one end of the main rod, elastic legs on the end of the main rod opposing the head portion, and at least two supports attached at an intermediate portion on the main rod. The elastic legs are in the shape of an inverted Y, and when the actuation rod is inserted in the container body the elastic legs contact its bottom. The supports contact the stop of the wall. A cap seals the fluid-filling hole of the container and has a discharge hole at its center. The head portion of the actuation rod closes the discharge hole of the cap when the container is assembled.

9 Claims, 8 Drawing Sheets

CONTAINER FOR FLUIDS

FIELD OF THE INVENTION

The present invention relates to a fluid container for containing fluids such as liquid detergent, liquid cosmetics, liquid shampoo, liquid condiments, and other liquid materials, the container being capable of retaining the fluids for a long time without leakage. The present invention also relates to a method of fluid discharge from the container, by which the fluid can be discharged from the container by such amount as needed.

DESCRIPTION OF THE PRIOR ART

Generally, when a fluid in a container is to be discharged from the container, the cap of the container is completely detached, and then, the fluid is discharged, thereby causing much inconvenience each time the task is carried out.

To solve this problem, some containers have been proposed in which is possible to discharge the fluid without detaching the cap from the container. For example, there is a container which has a hole at the center of the main cap body, and an outer cap member is attached upon the main body of the cap with a hinge so that the outer cap member can be opened and closed. When the fluid in the container is to be discharged, the outer cap member is opened; otherwise, the outer cap member is kept closed. Nonetheless, this device retains the inconvenience of closing and opening the outer cap member each time the fluid is to be discharged. Additionally, there is another disadvantage that the hinge can be damaged.

Another device has been proposed which has a bearing portion disposed at the center of the top of the cap. A rotatable lever having a knuckle portion with a straight discharge hole formed within it is assembled to the bearing portion, thereby discharging or retaining the fluid in the container through the manipulation of the rotatable lever. But this device has the disadvantages that the manipulation of the rotatable lever is very inconvenient, and that the constitution of the device is very complicated. Therefore, the components have to have a high precision, thereby increasing the manufacturing cost.

SUMMARY OF THE INVENTION

It is the object of the present invention to provide a fluid container and a discharge method in which the fluid can be discharged simply by pressing the body of the container by hand, and the body of the container is restored to the original state upon releasing the hand pressure to retain the fluid securely, thus the troublesome task of opening and closing of the cap being eliminated.

To achieve the above mentioned object, the container of the present invention is made of a thermoplastic material having elastic and flexible properties; a pair of at least one stop is formed inside the container; the container accommodates an actuation rod having a head portion at its upper tip, a pair of elastic legs at its lower tip, and a pair of supports at its intermediate position for engagement with the stop of the container; and a cap is placed on the mouth of the container. When the container is filled with a fluid, the head portion of the actuation rod seals the discharge hole of the cap, the contained fluid is not leaked, and a long term shelf life of the fluid is possible because impurities can not enter the container. When the container fluid is to be discharged for some use, the actuation rod can be downwardly moved upon pressing of the body of the container with hand, and thereupon, a gap is created between the head portion of the actuation rod and the discharge hole of the cap, thereby discharging the contained fluid. When the hard pressure is released, the body of the container is restored to the original shape, and at the same time, the cap is closed by the actuation rod. Thus the container of the present invention has a self-closing feature.

BRIEF DESCRIPTION OF THE DRAWINGS

The above object and other advantages of the present invention will become apparent by describing the preferred embodiments of the present invention in more detail with reference to the attached drawings in which.

DESCRIPTION OF THE PREFERRED EMBODIMENTS

The device of the present invention includes a container body, an actuation rod and a cap. More specifically, the device of the present invention is constituted such that the container body is made of an elastic and flexible material; the elastic actuation rod is supported upon a stop of the container body, and moves up and down as the container body is pressed. After insertion of the actuation rod into the container, the mouth of the container is closed with the cap having a discharge hole for the filled fluid. When the cap is placed on the mouth of the container as described above, the discharge hole of the cap and the head portion of the actuation rod are closely contacted each other, thereby preventing the leaking of the filled fluid.

Figure 1:
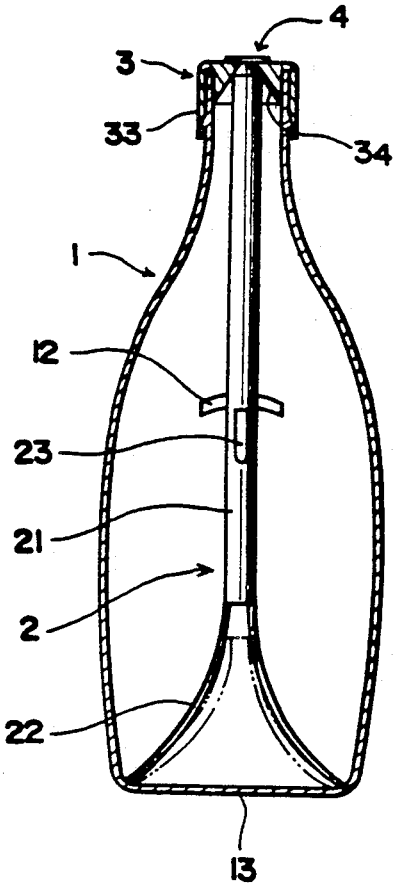
FIG. 1 is a cross-sectional view of the present invention.

FIG. 1 illustrates a container type which is generally suitable for use as a shampoo container. The container body 1 may have any desirable contour such as oval or cylindrical shape, and is made of a material having elastic, flexible and shape-restoring properties such as polyethylene.

Figure 5:
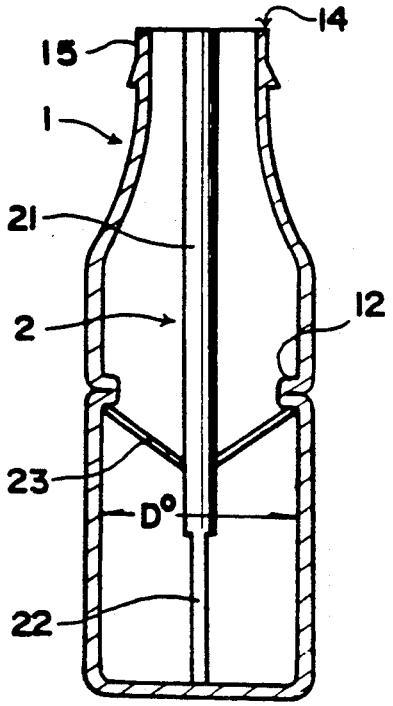
FIG. 5 is a cross-sectional view showing the body of the container.

As seen in FIG. 5, the inside or outside of the skirt portion of a fluid filling hole 14 is provided with inner or outer threads, while the inside or outside of the skirt portion of the cap is provided with inner or outer threads in such a manner that the threads of the container body and the threads of the cap can be coupled each other. Alternatively, the skirt portion 15 of the fluid filling hole 14 may be formed in a cylindrical shape without any thread, while the skirt portion 33 of the cap may be formed also in a cylindrical shape in such a manner that the cap can be tightly fitted to the skirt portion of the fluid filling hole. Thus, as long as an external force is not applied, the cap should be securely retained on the container body.

Figure 6:
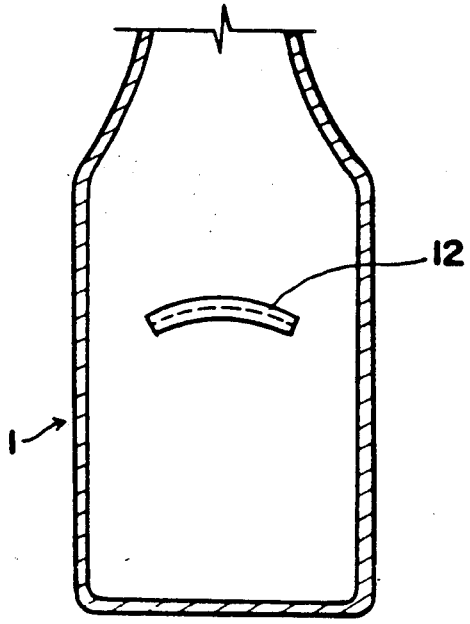
FIG. 6 is an exemplary view of the stop disposed in the container.
Figure 7:
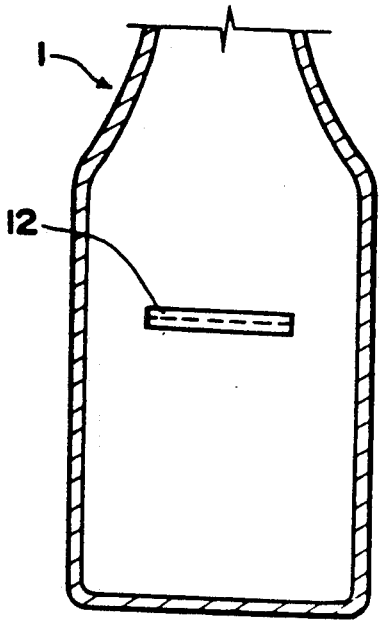
FIG. 7 shows a second embodiment of the stop.
Figure 8:
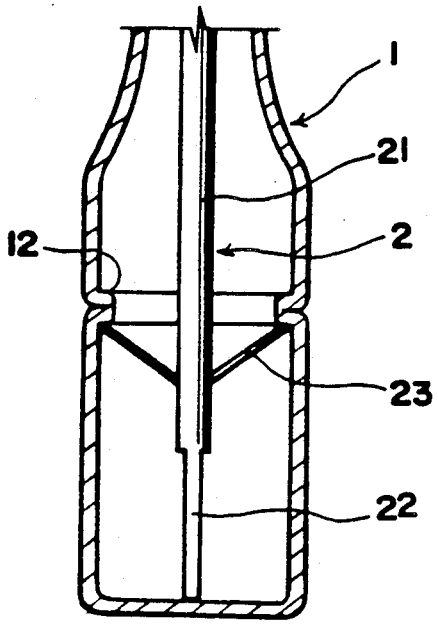
FIG. 8 shows a third embodiment of the stop which is formed around the inner circumference of the container body.
Figure 13:
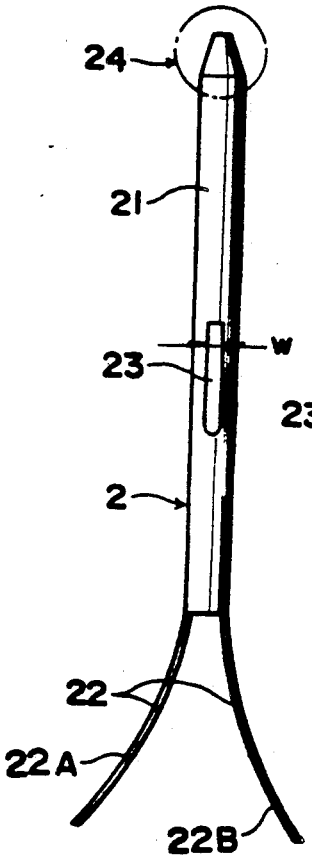
FIG. 13 is a view of the actuation rod.

A stop 12 is an important feature of the present invention. This stop 12 is projected from the inner wall of the container body to be a radially flat or curved shape. Where desirable, the stopp 12 can be formed through the total circumference of the inner wall of the container body. The arcuate stopp 12 as shown in FIG. 6 is especially suitable for the case where the supports 23 as seen in FIGS. 4 or 13 of the actuation rod 2 have a narrow width w, making it liable for the supports 23 to be slipped from the stopp 12, because the downwardly bent arcuate stopp 12 can prevent the slipping of the supports 23, thereby preventing undesired upward displacement of the actuation rod 2.

Figure 4:
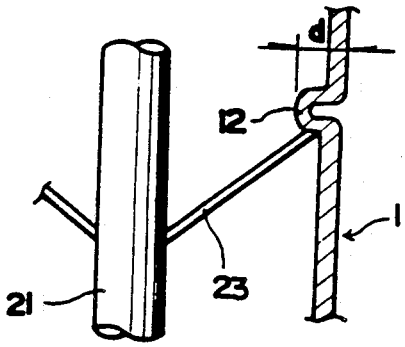
FIG. 4 is an enlarged sectional view of the portion A of FIG. 2.

The length d of the inwardly projected stopp as seen in FIG. 4 can also effect the efficiency of preventing this slipping, but in designing the length of the inwardly projected stopp 12, the manufacturing difficulty must be taken into account. The length of the stopp 12 thus determined and the outwardly directed elastic force (directed always toward the wall of the container body) of the supports 23 will play mutually complementing functions in order to completely prevent any undesired disengagement of the supports 23 from the stopp 12.

The stop 12 may be formed at any position on the container body, but it will be desirable to position it at the place where it is easy to use the hand to press the container. The position of the container where it is naturally easy to grasp may differ depending on the size of the container. However, in the case of a shampoo container, the desirable place is the middle one-third portion of the total shampoo container.

Figure 9:
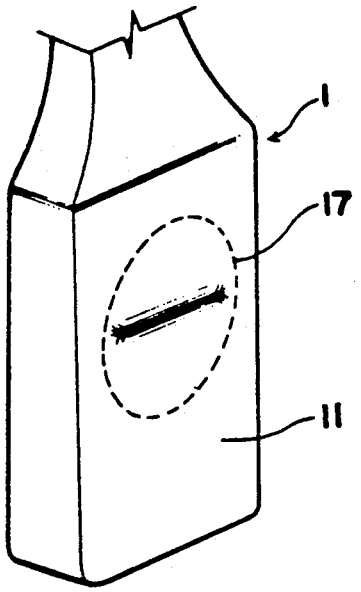
FIG. 9 is an exemplary view showing the pressure receiving area on the external wall of the container body.
Figure 10:
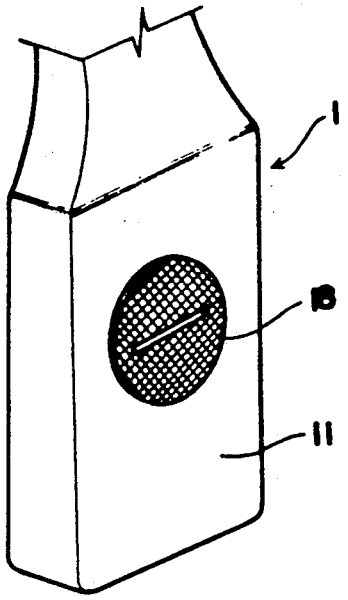
FIG. 10 is another exemplary view of the pressure receiving area constituted by small numerous protuberances.
Figure 11:
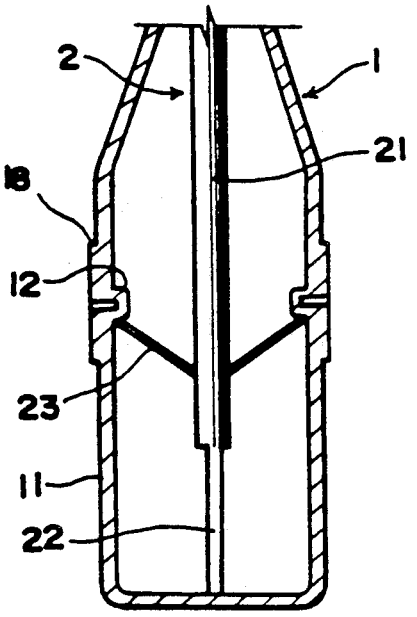
FIG. 11 is a cross-sectional view showing the pressure receiving area of FIG. 10.
Figure 12:
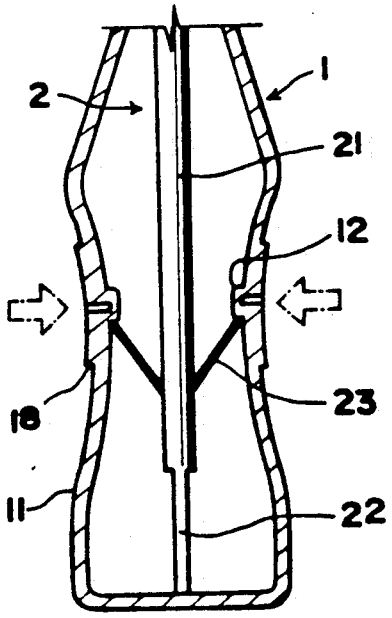
FIG. 12 is a cross-sectional view showing the pressure receiving area of FIG. 10 pressed with hand.

As shown in FIGS. 9 and 10, the grasping portion, that is, the pressure receiving area 17, 18 may be marked on the outer wall 11 of the container body 1 for proper use of the container.

The pressure receiving area can be desirably formed about the place where the thumb is touched on the one side of the container, and about the place where other fingers are conveniently touched on the other side of the container body. The size of the pressure receiving area should be large enough to receive two or more fingers. In forming the pressure receiving area 17, aesthetic features can be taken into account, and thus, some pictures can be placed on it. Alternatively, when the container is injection-molded, small numerous pits or small numerous protuberances can be formed on the pressure receiving area 18 as shown in FIG. 10. By means of these pits or protuberances, a picture of flowers or other objects can be formed on the pressure receiving area 18, and in any case, the person who holds the pressure receiving area should feel a feeling of softness and safety.

The actuation rod 2 is also an important feature of the present invention. The actuation rod 2 consists of a main rod 21, a head portion 24, stoppers 23 and elastic legs 22. The components of the actuation rod 2 are made of a material having good elastic, flexible and shape-restoring properties. The components can be made of the same material, but also can be made of different materials. The components can be either separately molded and properly joined, or they can be molded in an integral body. The cross section of the main rod 21 of the actuation rod 2 can have the shape of a circle, an ellipse, an angle, a channel, letter H, or letter I or any other proper shape. The main rod 21 can be formed either n a hollow type or in a solid type rod.

Figure 24:
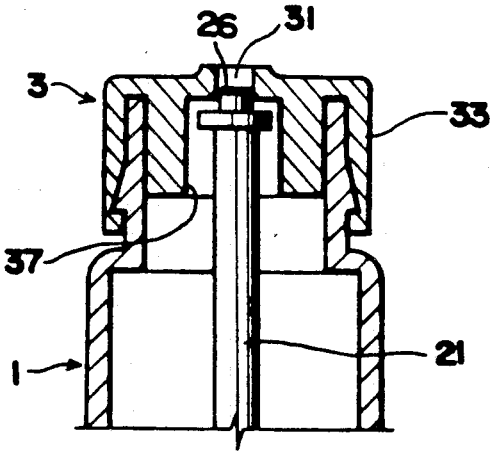
FIG. 24 is a cross-sectional view of the fourth embodiment of the cap.

FIGS. 13, 14 and 17 to 20 illustrate different types of the head portion of the actuation rod 2. When the actuation rod 2 is inserted into the container body, and the cap 3 is sealed to the mouth of the container body, the head portion 24 should contact closely with the discharge hole 31 of the cap 3. The actuation rod 2 makes the discharge of the content of the container possible when it is at the withdrawn position, and after the discharge of the content, the actuation rod 2 is moved up by being guided along the sloped portion of the cap 3 until a sealed state of the container is attained. In order to facilitate this operation, it is desirable to make the head portion 24 of the actuation rod 2 tapered (the tapered portion is designated by reference numeral 25). If the cap 3 is provided with a guiding portion 37 as seen in FIG. 24 to guide the head portion of the actuation rod 2 safely, then the head portion 24 of the actuation rod 2 can have a flat top.

The head portion 24 of the actuation rod 2 should be made of a material having a good connecting property (for contraction with the discharge hole) and a property allowing a smooth flow of fluids. Where the material used does not have the above mentioned properties or where an especially good contacting property is required due to the low viscosity of the fluid, the head portion 24 can have a separate packing member 27 having a good required property to the head 25, 26 of the actuation rod in order to achieve the purpose. FIGS. 13 to 16 illustrate different types of supports of the actuation rod. These supports 23 of the actuation rod 2 are made of a material having a good shape-restoring property, and are composed of at least two or more pieces 23A, 23B.

Figure 14:
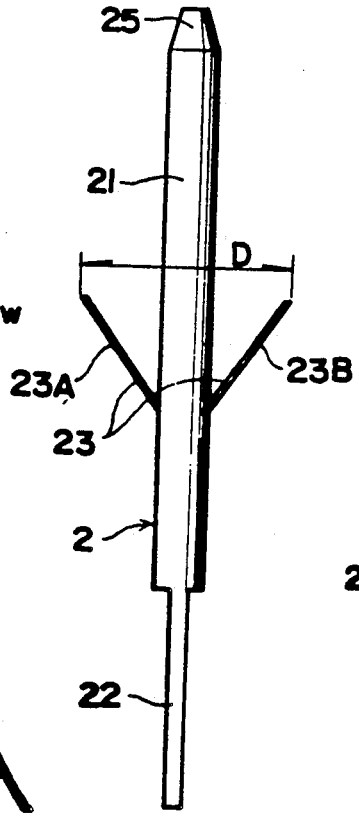
FIG. 14 is a side view of the actuation rod of FIG. 13.

In the case where a pair of the supports 23 are symmetrically disposed at the opposite sides of the main rod 21, and when these supports 23 are at their natural position, the horizontal distance D as seen in FIG. 14 between the upper tips of the supports 23A, 23B should be larger than the distance D between the opposite sides of the interior of the container body where stopp 12 is located (the distance D is the inside diameter of the container body if the container body is cylindrical). Thus the supports 23 of the actuation rod inserted into the container body always exert outwardly diverging elastic force toward the walls of the container body.

Figure 15:
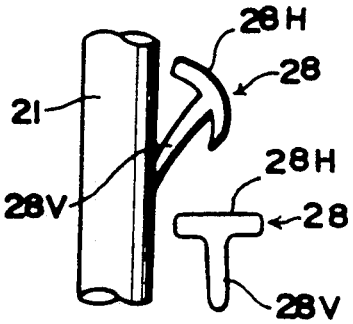
FIG. 15 is an exemplary view of another embodiment of the support of actuation rod.

The supports 28 of the actuation rod 2 as shown in FIG. 15 are formed respectively by joining a longitudinal piece 28V perpendicularly to a lateral piece 28H, and the lateral piece 28H has a predetermined length and is formed in an arcuate shape having a radius of curvature which is substantially the same as the radius of curvature of the container body 1 at the position where the stopper 12 is positioned.

Figure 16:
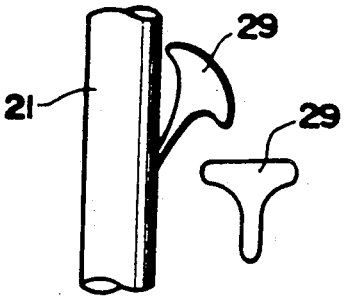
FIG. 16 is another embodiment of an exemplary view of the support of actuation rod.
Figure 17:
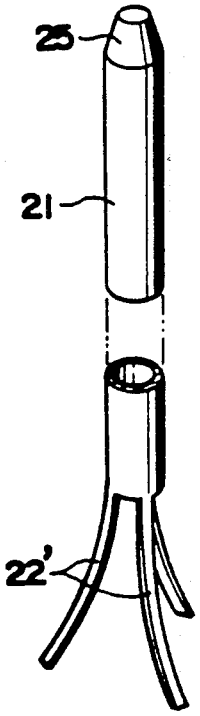
FIG. 17 is an exemplary view of the actuation rod having three elastic legs.
Figure 18:
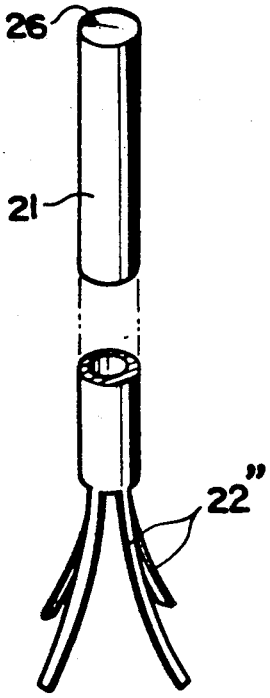
FIG. 18 is another exemplary view of the actuation rod having four elastic legs.
Figure 19:
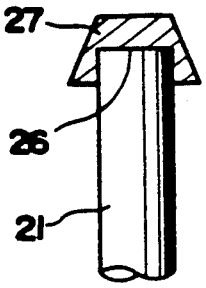
FIG. 19 is an exemplary view of the head portion of the actuation rod.
Figure 20:
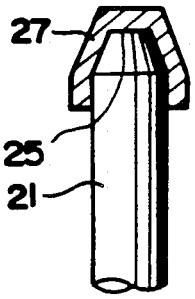
FIG. 20 is another exemplary view of the head portion of the actuation rod.
Figure 25:
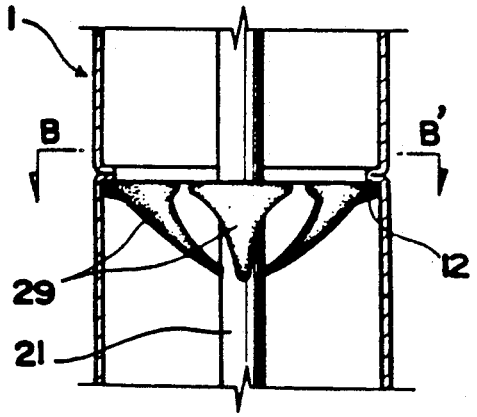
FIG. 25 is an exemplary view showing the stop of the cylindrical body of the container engaged with a plurality of the supports of the actuation rod.
Figure 27:
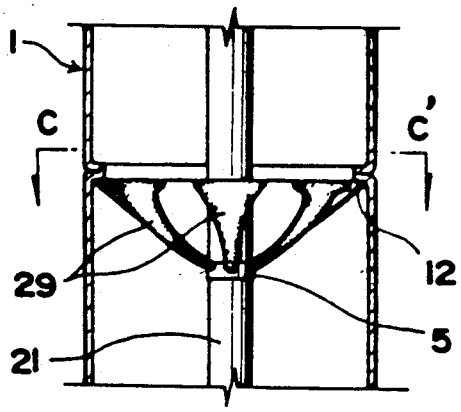
FIG. 27 is another exemplary view of the stopper of the container body engaged with the supports of the actuation rod.

FIG. 16 illustrates another embodiment of the support 29 of the actuation rod 2. In this support 29, aesthetic appearance is considered. The support 28, 29 of the actuation rod 2 can be used in a container body having an elliptical cross section, but they are especially suitable for the container body having a circular cross section. The reason for this fact and specific examples of use will be described below referring to FIGS. 25 and 28.

FIGS. 13, 14, 17 and 18 illustrate different types of the elastic legs of the actuation rod 2. The elastic legs 22 of the actuation rod 2 are made of a material having superior properties of elasticity and shape-restorability, and are composed of at least two or more elastic pieces 22A, 22D. The elastic pieces 22, 22', 22" can be constituted of two or more legs. The legs should be designed taking into account the relationship between the size of the elastic legs and the shape-restorability.

In the case where the elastic legs consist of two pieces 22A, 22B, they can be symmetrically joined or integrally molded to the lower tip of the main rod 21, and thus, the main rod 21 attached to the elastic legs 22 will take an inverted Y shape. In the case where three elastic legs are used, the elastic pieces are attached to the lower tip of the main rod 21 at equal angular distances respectively, and each pair of the elastic pieces together with the main rod 21 will take also an inversed Y shape.

FIGS. 21 to 24 illustrate different embodiments of the cap. The cap 3 is formed in such a manner that the cap 3 in cooperation with the head portion 24 of the actuation rod 2 seals the container to prevent the leaking of the fluid, and allows the discharge of the fluid when use of the fluid is needed. In the case where the head portion 24 of the actuation rod 2 is tapered, it is desirable that the guiding portion 34 of the cap 3 is also tapered.

Figure 21:
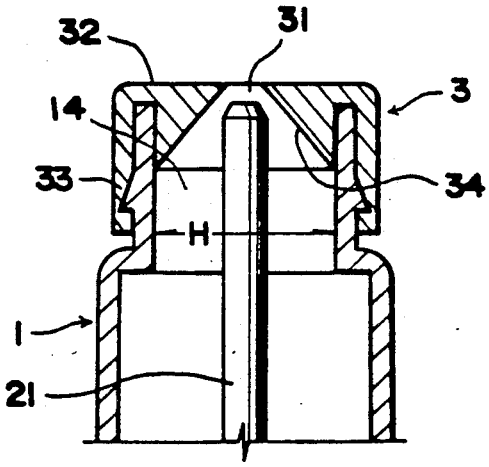
FIG. 21 is a cross-sectional view of the first embodiment of the cap.

In FIG. 21, the cap 3 has an upper face 32 formed integrally with a tapered guiding portion 34, providing a discharge hole 31 at the upper end of the tapered portion 34, and a thick material disposed between the upper face 32 and the tapered portion 34.

Figure 22:
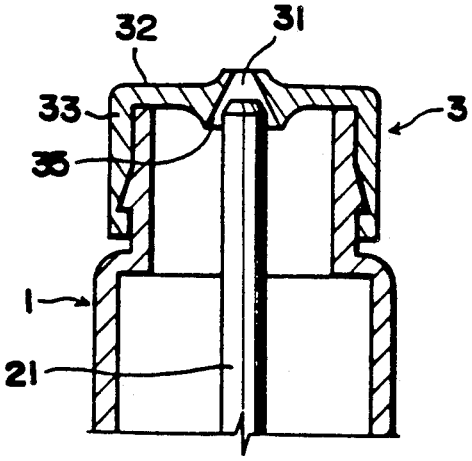
FIG. 22 is a cross-sectional view of the second embodiment of the cap.

In the cap 3 of FIG. 22, an upper plate 32 has the same thickness as that of the skirt portion 33, but a thick portion is formed at the center of the plate 32 to integrally form a tapered guiding portion 35 and a discharge hole 31, the tapered portion 35 being formed in such a manner that the head portion of the actuation rod 2 can not be disengaged from the tapered guiding portion 35 at the downwardly moved, discharge position of the actuation rod 2.

Figure 23:
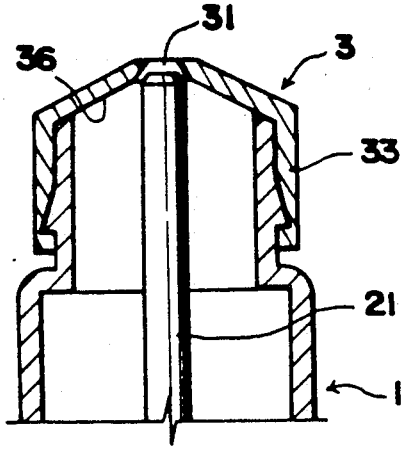
FIG. 23 is a cross-sectional view of the third embodiment of the cap.

In the cap 3 of FIG. 23, the whole upper plate 32 takes a conical shape, a discharge hole is formed at the top of the conical upper plate 32, and the whole inner surface of the conical upper plate 32 forms a guiding portion 36.

In the cap 3 of FIG. 24, a separate cylindrical guiding portion 37 is formed, with a thick wall of the guiding portion 37, and the guiding portion 37 is sufficiently long that the actuation rod 2 cannot disengage from the guiding portion 37. In this embodiment, the actuation rod 2 does not have a tapered head portion 24, but has a flat top 26. As described above, the discharge hole 31 of the cap 3 can be formed integrally with the guiding portion or separately from the guiding portion in a tapered form or in a cylindrical form.

Figure 2:
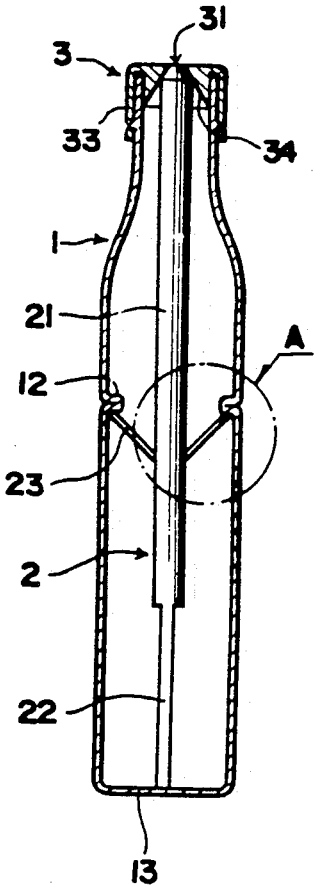
FIG. 2 is a side cross-sectional view of the device of FIG. 1, rotated 90°.
Figure 3:
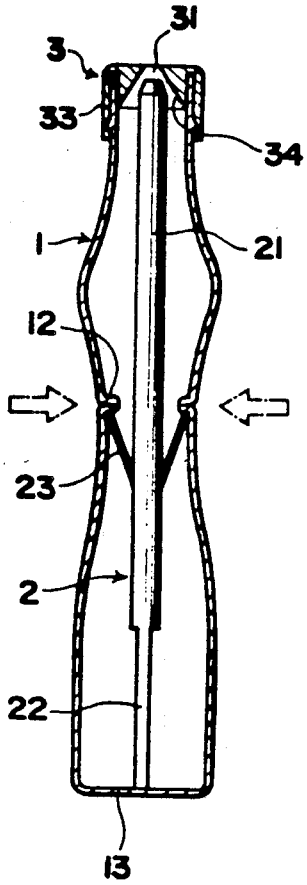
FIG. 3 is a cross-sectional view of the device of FIG. 2 showing the state of the container with pressure applied to the body of the container.

Now the assembling steps for the container of the present invention will be described with reference to FIGS. 1, 2 and 3. First the actuation rod 2 is inserted into the container body 1, with the elastic legs 22 forwardly directed. In the case where the container body 1 takes a cylindrical shape, the actuation rod 2 can be inserted with any angular direction of the elastic legs. Where the cross section of the container body 1 is an ellipse, the actuation rod 2 is inserted with the elastic legs 22 aligned with the longer diameter of the ellipse and the supports 23 of the actuation rod 2 aligned with the shorter diameter of the ellipse. When the elastic legs 22 touches the bottom 13 of the container body 1, the actuation rod 2 must be lightly pressed down so that the elastic legs 22 spread in opposite directions up to the ends of the bottom 13, and at the same time, the supports 23 of the actuation rod 2 are engaged with the stopp 12 of the container body 1. After fluid is poured into the container and the cap 3 is fitted to the mouth of the container body 1, the head portion 24 of the actuation rod 2 and the discharge hole 31 of the cap 3 are matched each other to seal the container, thereby preventing fluid leakage. In the assembling process described above, alternatively, first the fluid can be filled, and then, the actuation rod 2 can be inserted.

If the contained fluid is to be discharged from the container thus assembled, the pressure receiving areas (where the stoppers of the container body are located) of the container body 1 are grasped, and then the container is inverted so that the discharge hole 31 of the cap 3 is directed downwardly. Then, if the pressure receiving areas of the container body 1 are compressed, the support pieces 23A, 23B of the actuation rod 2 are deflected inwardly, and at the same time, the actuating rod 2 is withdrawn from the discharge hole 31, the elastic legs 22 also being deflected at the same time. On the other hand, if the compression of the pressure receiving areas is released, the actuation rod 2 is returned toward the discharge hole due to the elastic restoring force of the elastic legs.

Due to the withdrawal of the actuation rod 2 as described above, a gap is formed between the head portion 24 and the discharge hole 31 of the cap 3 to discharge the fluid through the gap. If it is desired to stop the discharge of the fluid, the pressure of the hand can be released so that the pressure receiving areas and the supports 23 of the actuation rod 2 are restored to the original state, and the actuation rod 2 returns the discharge hole 31 due to the elastic restoring force of the elastic legs 22, thereby sealing the discharge hole and stopping the discharge of the fluid.

If the container according to the present invention is to be commercialized, the discharge hole 31 can be additionally sealed by means of a sticker 4 (FIG. 1). Accordingly, the contents of the container will not be spilled even if the container body is struck during transportations and handlings. The sticker must be removed before the product of the present invention is used.

FIGS. 25 to 28 illustrate embodiment of the stopp of the actuation rod, which are applicable to a container body having a circular or substantially circular cross section. Their constitutions, functions and effects are almost the same as those of the first embodiment, differing only in that, unlike the elliptical cross sectional container body, the cylindrical container body should be operable when any middle portion of the body is pressed. For this purpose, the stopp 12 of the container body 1 forms an inwardly projected annular ring formed along the entire circumference of the inner side of the container body, and the supports of the actuation rod 2 are composed of a plurality of support pieces, each of which is same as the supports 28, 29 as shown in FIGS. 15 and 16, the support pieces being arranged in a sloped radial shape for engagement with the inwardly projected annular ring type 12.

The number of the supports of the actuation rod 2 will depend on the size of the container body, and in the case where 4 to 10 pieces are enough, it is desirable to provide the support pieces of the actuation rod in an even number. In the case where the size of the container body is larger, requiring a larger number of support pieces of the actuation rod, it will be desirable to provide an attachment ring 5 because the diameter of the main rod 21 of the actuation rod 2 is relatively too small.

Figure 26:
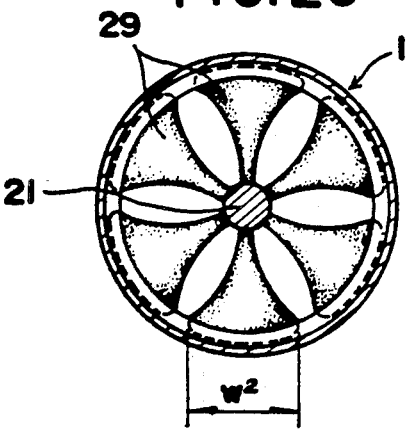
FIG. 26 is plan view taken along the line B—B' of FIG. 25.
Figure 28:
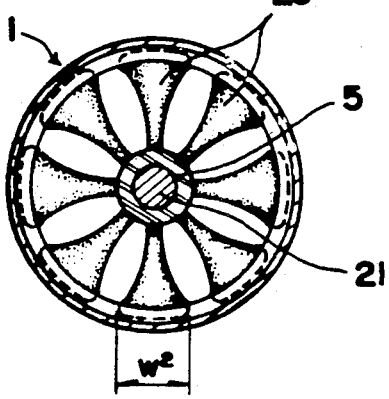
FIG. 28 is a plan view taken along the line C—C' of FIG. 27.

The width W2 as seen in FIGS. 26 and 28 of each support piece of the actuation rod should be smaller than the diameter H of the fluid filing hole 14 as seen in FIG. 21 to such extent that the actuation rod provided with a plurality of the supports can easily be inserted into the container body.

The point to be especially emphasized in this embodiment is that the supports of the actuation rod, upon being inserted into the container body, should exert a stretching force in the outward direction to contact the inner wall of the cylindrical container body. This condition must be met, if some pieces of the supports are to be prevented from being disengaged from the annular stopp of the container body. That is, if a certain portion of the container body is pressed, the side portions of this cylindrical container is expanded, and in this situation, the support pieces of the actuation rod corresponding to the expanding portion of the container body would disengage from the annular stopp of the container body, if the support pieces do not have the self stretching force.

Figure 29:
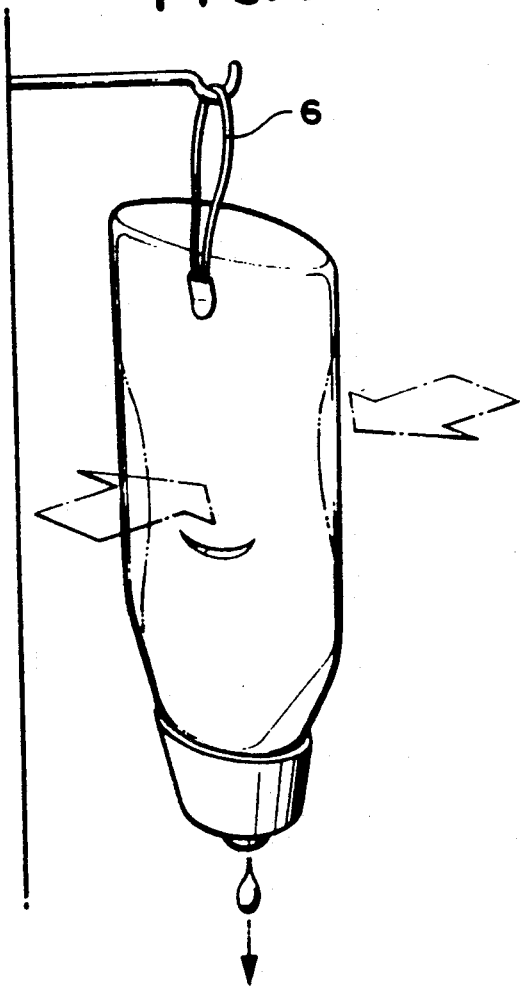
FIG. 29 is an exemplary view showing a state of use of the container, in which the container with a string attached on it is hung to a hook.

The container according to the present invention may conveniently be hung to a hook by attaching a string 6 to the container. FIG. 29 illustrates such a case. If the contained fluid is to be used with the container hung to a hook, the pressure receiving areas are pressed with a hand to discharge the fluid, while, if the pressure of the hand is released, then the container is restored to the original state, the discharge of the fluid is stopped, and the contained fluid is kept safely as usual.

The container according to the present invention can be used to contain various fluids such as shampoos, liquid cosmetics, liquid detergents, liquid adhesives, bonds, mayonnaise, liquid condiments, and other liquid or high viscosity materials.

The present invention was described based on the illustrated embodiments, but it should be understood that various changes and modifications can be added to the device of the present invention without departing from the scope of the present invention.

What is claimed is:

1. A container for fluids comprising:

a container body having a flat bottom, a wall extended from the bottom, and a fluid-filling hole opposing the bottom, said wall being made of an elastic material and provided with at least one internal stop;

an actuation rod consisting of a main rod, a head portion formed at the upper tip of the main rod, elastic legs attached to the lower tip of the main rod in an inverted Y-shape, and at least two supports attached at an intermediate portion of the main rod for engagement with the stop of the wall, said actuation rod being inserted into the container and contacting the flat bottom; and a cap sealed to the fluid-filling hole of the container and having a discharge hole disposed at the center of the cap, said head portion being inserted into the discharge hole.

2. The container as claimed in claim 1, wherein the stop of the container body is an annular ring which extends around the entire circumference of the cylindrical container body, and projects radially inwardly from the cylindrical container body.

3. The container as claimed in claim 2, wherein the head portion of the actuation rod comprises a packing member having a good contactsealing property attached to the head of the actuation rod.

4. The container as claimed in claim 2, wherein a pressure receiving area is disposed on the external side of the wall where the annular stop of the container body is disposed.

5. The container as claimed in claim 2, further comprising a sticker covering the discharge hole.

6. The container as claimed in claim 1, further comprising a sticker covering the discharge hole.

7. The container as claimed in claim 1, wherein the head portion of the actuation rod comprises a packing member having a good contactsealing property attached to the head of the actuation rod.

8. The container as claimed in claim 1, wherein pressure receiving areas are disposed on opposing external sides of the wall of the container body where the at least one stop of the container body is positioned.

9. The container as claimed in claim 1, further comprising a string attached to an external position of the container body.

* * * * *